United States Patent [19]

Spaller, Jr.

[11] 3,999,716

[45] Dec. 28, 1976

[54] TRANSFER TAIL APPARATUS FOR USE WITH TEXTILE YARN WINDERS

[75] Inventor: Albert E. Spaller, Jr., Johnson City, Tenn.

[73] Assignee: Eastman Kodak Company, Rochester, N.Y.

[22] Filed: Feb. 9, 1976

[21] Appl. No.: 656,230

[52] U.S. Cl. ..... 242/18 PW

[51] Int. Cl.[2] ..... B65H 54/02

[58] Field of Search ..... 242/18 PW, 18 A, 18 DD

[56] References Cited

UNITED STATES PATENTS

| | | | |
|---|---|---|---|
| 3,149,795 | 9/1964 | Rhein, Jr. | 242/18 A |
| 3,224,692 | 12/1965 | Nugent | 242/18 PW |
| 3,251,560 | 5/1966 | Macedo | 242/18 PW |
| 3,275,252 | 9/1966 | Bolger | 242/18 PW |
| 3,276,704 | 10/1966 | Pabis | 242/18 PW |
| 3,282,516 | 11/1966 | Porter | 242/18 PW |
| 3,408,011 | 10/1968 | Lenk et al. | 242/18 PW |
| 3,428,266 | 2/1969 | Emery | 242/18 PW |
| 3,575,355 | 4/1971 | Ratti | 242/18 PW |
| 3,792,818 | 2/1974. | Bauer et al. | 242/18 PW |
| 3,971,518 | 7/1976 | Newman et al. | 242/18 PW |

*Primary Examiner*—Stanley N. Gilreath
*Attorney, Agent, or Firm*—D. B. Reece, III; Malcolm G. Dunn

[57] ABSTRACT

In a transfer tail apparatus of the type disclosed in the Newman et al. U.S. Pat. application Ser. No. 524,902, filed Nov. 18, 1974, now U.S. Pat. No. 3,971,518 and having first and second yarn guides each movable in a path from an unlatched position to a latched position and upon release and in return to the unlatched position, the one yarn guide translates a yarn into engagement with the outer axial end of a rotating yarn package tube for subsequent snagging by a slit in the end of the tube and the other yarn guide guides the snagged yarn onto an end portion of the yarn tube to form a waste bunch to secure the snagged yarn to the yarn tube and then along the end portion to form a transfer tail and finally releases the yarn for subsequent pickup by a yarn traverse guide to form the yarn package; the improvement comprising a readily visible and accessible single cocking mechanism for moving both yarn guides essentially simultaneously to their respective latched positions and including a lost motion arrangement by which a time delay is provided between the return movement of the first yarn guide to the unlatched position and the return movement of the second yarn guide to the unlatched position, which lost motion arrangement also includes a latching arrangement for the second yarn guide, further includes a back travel arrangement for the yarn laying guide to provide tying wraps across the waste bunch and still further includes an arrangement to give an impetus to the second yarn guide to overcome its inertia when released from its latched position to bring it up to a desired speed in return to the unlatched position.

6 Claims, 3 Drawing Figures

TRANSFER TAIL APPARATUS FOR USE WITH TEXTILE YARN WINDERS

BACKGROUND OF THE INVENTION

This invention is directed to a transfer tail apparatus for use with textile winders on which textile and industrial yarns are wound into packages, especially to an apparatus for forming a transfer tail on a yarn package support or tube, which is rotating at high speeds; and particularly to an improvement in the transfer tail apparatus disclosed in U.S. patent application Ser. No. 524,902, "Transfer Tail Apparatus for Use with Textile Yarn Winders", filed Nov. 18,1974, now U.S. Pat. No. 3,971,518 in the names of Larry B. Newman and John W. Demuth.

Devices and apparatus for forming transfer tails on yarn package supports, particularly on yarn package supports that are rotating at the desired yarn package winding speeds, are well-known in the art. Some of these prior art devices or apparatus are represented in the Pabis patent, U.S. Pat. No. 3,276,704; the Rhein, Jr., patent, U.S. Pat. No. 3,149,795; the Nugent patent, U.S. Pat. No. 3,224,692; the Ratti patent, U.S. Pat. No. 3,575,355; the Emery patent, U.S. Pat. No. 3,428,266; the Porter patent, U.S. Pat. No. 3,282,516; the Bolger patent, U.S. Pat. No. 3,275,252; and the Bauer et al. patent, U.S. Pat. No. 3,792,818.

The textile winders concerned with this invention usually involve a yarn package support, which may be surface-driven, and where the traversing action for even distribution of the yarn on the yarn package support may be obtained by use of a drive roll having a spiral groove in its surface to traverse the yarn as it is wound on the package, as in the case of the above-mentioned Nugent patent, U.S. Pat. No. 3,224,692. The traversing action may also be accomplished by the reciprocating motion of a yarn traverse guide through which the yarn advances to the yarn package support or tube, as in the case of the above-mentioned Pabis patent, U.S. Pat. No. 3,276,704, and the Bauer et al patent, U.S. Pat. No. 3,792,818.

The "transfer tail" is an initial wrap or turn or series of wraps or turns in the form of a single layer of a short length of helices at one end of the yarn package support or tube just outside the package portion of the tube. The purpose of the transfer tail is to facilitate the tying of the outer end of yarn from another yarn package to the transfer tail of the yarn package being processed or used in a textile mill so as to preserve the continuity of the operating process without having to shut equipment down when a yarn package becomes depleted.

The winder for which this invention, the transfer tail apparatus, is particularly adapted is the BARMAG SW4S Winder, Barmer Machinenfabrik, A.G., which winds yarn onto packages at speeds in excess of 3000 meters per minute. The above-mentioned Bauer et al patent, U.S. Pat. No. 3,792,818, appears to disclose a winder somewhat similar to the BARMAG winder.

a. Newman et al. Patent Application

In the pending Newman et al. patent application, the transfer tail apparatus is adapted to form a transfer tail on the outer end portion of a rotating yarn package tube when the yarn is traveling at speeds in excess of 3000 meters per minute. The transfer tail apparatus is also capable of being used with winders operating at slower speeds. The rotating yarn package tube is horizontally mounted on a yarn winder. The yarn winder has a self-threading yarn traverse guide, which is driven in reciprocation along a path that is parallelly spaced from the package portion of the yarn package tube and which guides the yarn onto the package portion of the tube. The yarn package has formed in its outer axial end an end slit for snagging and retaining yarn. Other yarn snagging arrangements may also be provided in lieu of the end slit in the tube, such as an arrangement that is part of the tube or that is part of the mandrel on which the tube is mounted for rotation. It is only necessary that the snagging arrangement be at a location at the outer axial end of the tube where there is no interference with the surface drive of the yarn package tube or with the formation of any of the wraps on the tube. It is also necessary that the snagging arrangement be effective in enabling the yarn to commence winding on the yarn package tube.

The transfer tail of the Newman et al pending application thus includes a yarn laying guide and a pigtail yarn guide, through each of which the continuously moving yarn is initially threaded by the operator by means of an air doffer in preparation for tie-up or connection of the yarn to the rotating yarn package support or tube. The yarn laying guide and pigtail yarn guides are each adapted to be moved in a predetermined path, as in an arcuate path, from a first position to a latched second position; and upon release from the latched position, to be moved in return along the path to the first position. The movement of each of the two guides is powered and controlled by a spring arrangement, which is adjustable and is sufficiently large and steady as compared to the tension on the yarn and to any frictional changes in the system.

As the pigtail yarn guide is moved by the spring arrangement along the predetermined path in return to the first position from the latched position, the pigtail yarn guides translates the yarn into engagement with the outer axial end of the yarn package tube, whereupon the yarn becomes snagged and retained on the tube by the end slit when the end slit rotates clockwise (as viewed from the front of the apparatus) into the snagging position. In the instance of other yarn snagging arrangements located at the outer axial end of the yarn package tube, either as part of the tube or otherwise, the movement of the pigtail yarn guide would still bring the continuously moving yarn across at the outer axial end of the tube where the yarn snagging arrangement would be located. The yarn is then severed by snapping from the yarn continuing on to the air doffer as a result of the sudden increase in tension between the snagged yarn and the yarn passing into the air doffer. The yarn laying guide then guides the yarn into a waste bunch of a predetermined number of wraps on the outer axial end of the yarn package tube sufficient to assure retention of the yarn on the yarn package tube, after which the yarn laying guide is automatically released for movement in return to its first position. In the course of its return movement, the yarn laying guide is moved at such a rate relative to the rotation of the yarn package tube so as to form on the yarn package tube a transfer tail of a predetermined number of spaced wraps or helices, and then releases the yarn for subsequent pickup by the self-threading yarn traverse guide to thereafter wind yarn on the package portion of the yarn package tube.

The automatic release of the yarn laying guide from its latched position is preferably controlled by the pigtail yarn guide when it reaches a predetermined position along its path of return movement. Suitable mechanism linking the pigtail yarn guide with the yarn laying guide may be provided, such as a mechanically-activated or electrically activated time delay mechanism, which may be triggered after a predetermined interval following release from the latched position of the pigtail yarn guide.

The yarn laying guide shown in the pending Newman et al. patent application is generally U-shaped in configuration, has two spaced leg portions that are inclined upwardly and lie in planes extending above the axis of the yarn package tube and extend generally toward the yarn package tube when the yarn laying guide is in the latched second position. One of the leg portions is offset below and toward the other leg portion, and the other leg portion terminates in an L-shaped leg portion that lies above the first mentioned leg portion. The L-shaped leg portion is generally parallel with the yarn package tube and extends in a direction toward the outer axial end of the yarn package tube when the yarn laying guide is in the latched second position. The purpose of this construction is explained in the Newman et al. patent application.

When the yarn laying guide and the pigtail yarn guide are in their respective latched positions, the pigtail guide is then located in front of the outer axial end of the horizontally disposed yarn package tube; and the yarn laying guide is located at about the 10 o'clock position, relative to the location of the pigtail guide and adjacent the outer axial end of the yarn package tube. The yarn, prior to tie-up, approaches the yarn winder from at least one godet roll above and axially inwardly to one side of the winder and passes over a pair of guide bars, which extend horizontally from the yarn winder a predetermined distance axially inwardly from the outer axial end of the yarn package tube and are positioned parallel to the yarn package tube. Then the yarn passes through the yarn laying guide, through the pigtail guide and into a yarn waste receiver by means of an air doffer or other yarn aspirating device. When the pigtail yarn guide is released from its latched position by the operator, it translates the continuously moving yarn into engagement with the outer axial end of the rotating yarn package tube, and when the end slit on the tube, or other yarn snagging arrangement at the outer axial end of the tube, comes around in clockwise manner to about the 10 o'clock position on the tube, as viewed when standing in front of the outer axial tube end or relative to the location of the pigtail guide, the snagging operation takes place. When the yarn is snagged, the sudden increase in tension on the yarn between the tube end slit or yarn snagging arrangement and the yarn passing into the yarn aspirating device or air doffer causes the yarn to snap or become severed. The yarn is then retained on the tube for subsequent winding thereon. Since the snagging operation takes place substantially in line with the path of approach of the yarn and also the final path of the yarn when the waste bunch commences to be formed, any tendency for any slack to occur in the yarn between the location of the snagging operation and the last godet roll above the winder is minimized.

When the yarn is finally released from the yarn laying guide for subsequent pickup by the self-threading yarn traverse guide, the tension on the yarn from above and axially inwardly of the yarn package tube causes the yarn to continue to be moved axially inwardly a short distance along the pair of horizontally extending guide bars and then into the self-threading yarn traverse guide.

The preceding description describes the character and operation of the transfer tail apparatus in the pending Newman et al patent application, and the transfer tail in the instant invention is formed in the same manner.

b. This Invention

An object of this invention, however, is to provide a transfer tail apparatus that is safer to use by the operator so that the operator in mainpulating the yarn laying guide and pigtail yarn guide no longer needs to have his hand blindly near high speed moving parts in order to move the two yarn guides to their latched second position, as is the situation in the pending Newman et al patent application. In the latter invention, the operator threads up the yarn laying guide, manually cocks it or moves it to the latched position; and then manually cocks the pigtail yarn guide or moves it to the latched position, after which he threads up the pigtail yarn guide. In both manual movements the operator has to move his hands blindly under the apparatus and close to high speed rotating parts.

SUMMARY OF THE INVENTION

An object of this invention, therefore, is to provide in a transfer tail apparatus of the type heretofore described a single cocking mechanism that is readily visible and accessible to the operator and that serves to cock or move the yarn laying guide and the pigtail yarn guide at essentially the same time to the latched second position, preparatory to the transfer tail formation, without the operator bringing his hands near any high speed moving parts on the yarn winder.

Another object of the invention is to provide for the yarn laying guide a limited back travel arrangement, which will be effective prior to the time of the formation of the transfer tail so as to provide tying wraps from one side to the other and in return, or in other words, across the waste bunch, so as to minimize the risk of the waste bunch accidently coming off the yarn tube and hence pulling with it the formed transfer tail.

Still another object of the invention is to improve mechanical endurance of the apparatus, minimize the number of parts by having them perform more functions and thereby reduce fabrication costs, and make it easier for the operator to operate the transfer tail apparatus.

Other objects inherent in nature of this invention will become apparent to those skilled in the art to which this invention pertains from the disclosure contained herein.

The single cocking mechanism, therefore, has a handle that is positioned at the top of the transfer tail apparatus and is of such size as to enable the operator to easily cock the transfer tail mechanism with one hand. A cocking shaft extends from the handle and is connected to the pigtail yarn guide at the opposite end from the handle and is also connected to the yarn laying guide by mechanism which also includes a lost motion mechanism operable by the pigtail yarn guide during its return movement from the latched second position for effecting a sequential subsequent release of the yarn laying guide from its latched second position.

which lost motion mechanism also includes a latching mechanism for the yarn laying guide, further includes a back travel arrangement for the yarn laying guide to provide tying wraps across the waste bunch and still further includes a mechanism to give an impetus to the yarn laying guide to overcome its inertial when released from its latched position to bring it up to a desired speed in return to the unlatched position.

The mechanism between the cocking shaft and the yarn laying guide includes a throw member that is connected to the cocking shaft; a link member pivotally connected at one of its ends to one end of the throw member; a rotatable throw member pivotally connected to the other end of the link member; a rotatable shaft connected to and for rotation with the rotatable throw member, the rotatable shaft having a pair of oppositely disposed shoulders; a rotatable cam throw concentrically disposed around but freely rotatable relative to the rotatable shaft and having an abutment member projecting therefrom for engagement into rotation in one direction or the other by one of the oppositely disposed shoulders on the rotatable shaft; and a spring-biased cam link pivotally connected at one end to the rotatable cam throw and at its other end pivotally connected to the yarn laying guide.

The rotatable shaft with the pair of oppositely disposed shoulders, and the rotatable cam throw with the projecting abutment member constitute a part of the lost motion mechanism by which a suitable time delay is provided between the return movements of the first yarn guide or pigtail yarn guide and of the second yarn guide or yarn laying guide, when they are released from their respective latched positions. During such time delay, the time it takes for one oppositely disposed shoulder to move from one side of the projecting abutment member and the other oppositely disposed shoulder to move into engagement with the other side of the projecting abutment member, the released pigtail yarn guide translates the yarn into snagging engagement with the yarn package support and the latched yarn laying guide guides the snagged yarn onto an end portion of the yarn tube to form a waste bunch to secure the snagged yarn to the yarn tube, and then the yarn laying guide is released for its return movement to form the transfer tail and release the yarn for subsequent pickup by the yarn traverse guide.

The rotatable cam throw; the projecting abutment member from the rotatable cam throw; and the spring-biased cam link, which is pivotally connected at its one end to the rotatable cam throw and at its other end to the yarn laying guide, constitute part of an over-the-center toggle mechanism. The toggle mechanism is moved past its center into a latching position against a stop member by one of the oppositely disposed shoulders on the rotatable shaft to latch the yarn laying guide in the latched second position. In this manner, it constitutes a latching mechanism.

When the toggle mechanism is moved in the opposite direction by the other of the oppositely disposed shoulders on the rotatable shaft, the spring-biased cam link moves toward center position and causes the yarn laying guide to move backward a short distance, thereby guiding some tying wraps across the waste bunch; that is, the tying wraps extend from one side of the waste bunch to the other side so as to secure the waste bunch more firmly to the end portion of the yarn tube. When the spring-biased cam link is moved past the center position, the yarn laying guide moves forward, thus guiding the tying wraps in return from the other side of the waste bunch to the first side preparatory to forming the transfer tail. This, therefore, constitutes a back travel arrangement for the yarn laying guide.

When the toggle mechanism continues to move past the center position toward the release of the yarn laying guide, a spring acting on one end of the cam link serves to provide impetus to the toggle mechanism as it moves over the center, the impetus also serving to extend to the yarn laying guide when released to overcome its inertia and bring it up to a desired return speed to the unlatched position.

The lost motion mechanism, in part, also serves as part of a releasing mechanism for the latching mechanism for the yarn laying guide, when the other oppositely disposed shoulder is moved into engagement against the other side of the projecting abutment member.

DESCRIPTION OF THE PREFERRED EMBODIMENT

Figure 1:
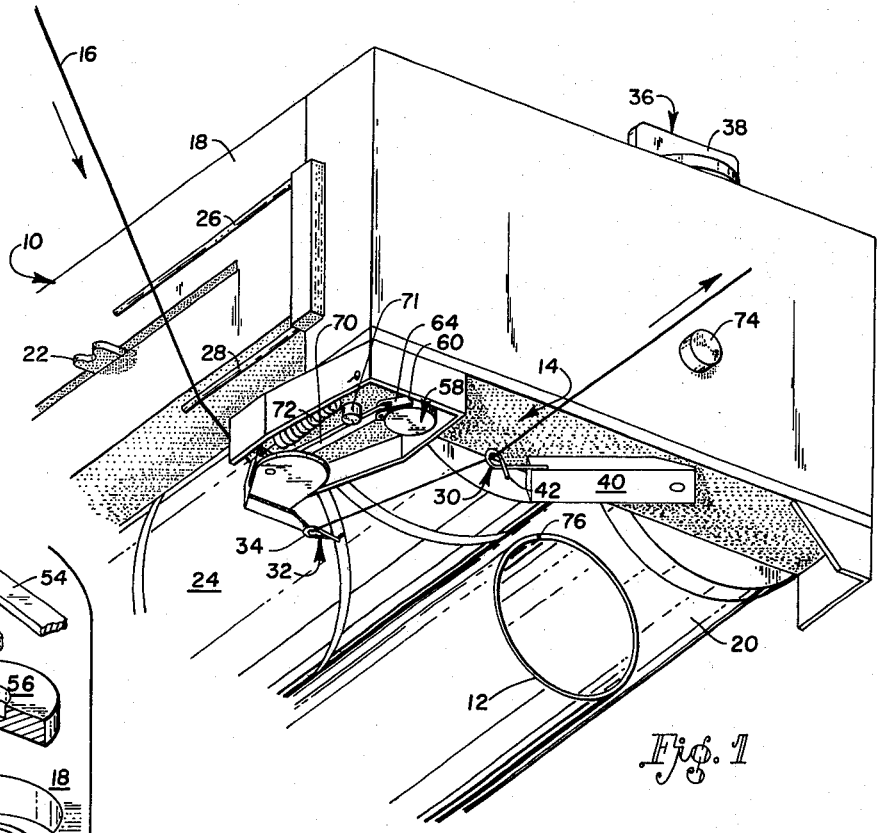
FIG. 1 is an overall isometric view of the underside of the transfer tail apparatus, as connected to a yarn traverse winder, and illustrates the path of yarn approach from above the winder.

In reference to FIG. 1 of the drawings, a yarn traverse winder is shown at 10, a yarn package support or tube at 12 and the transfer tail apparatus at 14. The yarn 16 approaches the winder from above the winder, as from a godet roll (not shown), and initially passes into an air doffer (not shown) to a waste receiver (not shown) prior to being connected to the yarn package tube 12.

The pertinent portions of the winder shown include the yarn traverse winder housing 18, which is suitably, vertically movable toward and away from the yarn package tube (not illustrated); the drive roll 20 for surface drive engagement with the yarn package tube; a self-threading yarn traverse guide 22 and a grooved roll 24, each of which cooperates in a known manner to guide the yarn onto the package portion of the yarn package tube; and a pair of guide bars 26, 28, which extend horizontally a predetermined distance axially inwardly from the outer axial end of the yarn package tube and are positioned parallel to the yarn package tube. The guide bars 26, 28 initially serve to prevent the yarn from being picked up by the yarn traverse guide prior to tie-up of the yarn to the yarn package tube.

In reference now to all of the drawing figures, the transfer tail apparatus 14 comprises a first yarn guide or pigtail yarn guide 30 and a second yarn guide or yarn laying guide 32, each of which are adapted to be moved in a predetermined path, or in a substantially horizontal plane, as illustrated in the particular preferred embodiment shown in these drawings. The "first" and "second" designations of the two yarn guides are in the order of the occurrence of their respective operations in forming the transfer tail and are not in the order of the path of approach of the yarn to the winder.

The elements heretofore identified are the same as those described in the pending Newman et al. patent application, and reference may be made to it for a description and purpose of the various legs of the U-shaped guide 34 constituting part of the second yarn guide or yarn laying guide 32.

The improved mechanism includes a spring-biased cocking shaft 36, the handle or knob 38 of which extends above the yarn traverse winder housing 18 for easy access to the operator. The cocking shaft is suitably journalled for rotation in the upper and lower walls of the housing and is urged to the return position or first position by the torsion spring 37. The first yarn guide or pigtail yarn guide 30 comprises a swinging guide bar 40, which is connected for swinging movement below the lower wall of the housing to the lower end of the cocking shaft that extends through the lower wall, and a pigtail guide 42, which is connected to the outer end of the swinging guide bar remote from the point of connection of the swinging guide bar to the cocking shaft.

Figure 2:
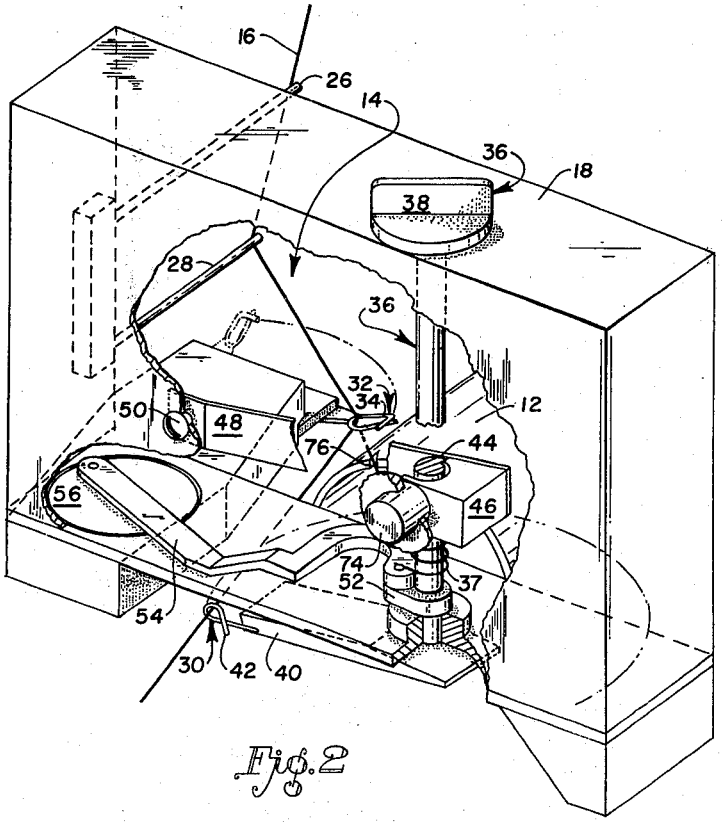
FIG. 2 is an isometric view of the transfer tail apparatus with the front wall broken away in part to illustrate the connecting mechanism between the cocking shaft and each of the yarn guides.

The spring-biased cocking shaft 36 is provided with a latch tongue 44, (FIG. 2) which is formed to extend tangentially from the shaft for latching cooperation with an abutment member 46, the latter in turn being spring-biased into abutment with the latch tongue 44 by spring member 48. The remote end of the spring member is secured to the yarn traverse winder housing, as shown in FIG. 2 at 50.

Figure 3:
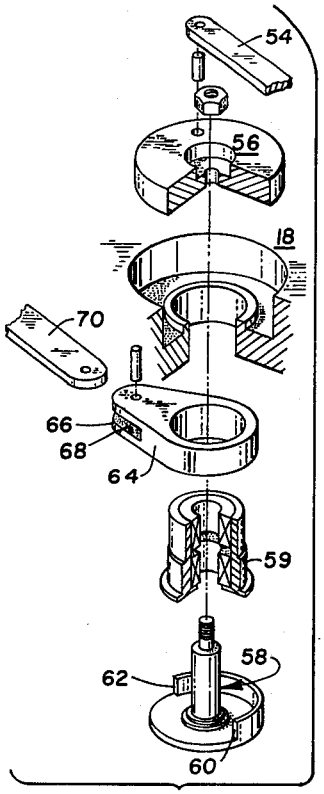
FIG. 3 is an exploded isometric view broken away and partly in cross-section to illustrate the rotatable shaft, which extends through the housing for connection at one end to the rotatable throw member and the rotatable cam throw that is concentrically disposed around the rotatable shaft.

Also connected to the cocking shaft is a cocking shaft throw 52, which is a crank-like member secured for rotation with the cocking shaft. A connecting link member 54 is pivotally connected at one of its ends to one end of the cocking shaft throw; and a rotatable throw member 56 is pivotally connected to the other end of the connecting link member 54. A rotatable shaft 58 is connected to and for rotation with the rotatable throw member 56 and is suitably journalled through the winder housing wall for such rotation by a bearing assembly 59, in the manner illustrated in FIG. 3. The rotatable shaft has a pair of oppositely disposed shoulders 60, 62, for a purpose to be described.

A rotatable cam throw 64 is concentrically disposed around the rotatable shaft 58 and is freely rotatable relative to the rotatable shaft. The rotatable cam throw also has an abutment member 66 projecting therefrom for engagement with either of the pair of oppositely disposed shoulders on the rotatable shaft for driving in rotation in one direction or the other the rotatable cam throw.

The abutment member 66 is bifurcated or slotted at 68 to pivotally receive one end of a cam link 70. The other end of the cam link is in turn pivotally connected to the second yarn guide or yarn laying guide 32. A spring 72 (FIG. 1) is connected to an ear portion on the cam link adjacent its pivotal connection to the yarn laying guide and serves to urge the yarn laying guide in return to the first position.

The Operation

In operation, the operator takes an air doffer (not shown) into which the yarn is moving in excess for 3000 meters per minute, passes the yarn 16 into the U-shaped guide 34 in the first position of the second yarn guide or yarn laying guide by threading the yarn into the legs of the guide.

The operator then manually cocks the transfer tail forming mechanism by rotating the handle or knob 38, thereby rotating the cocking shaft 36 and the first yarn guide or pigtail yarn guide 30, and camming the latch tongue 44 on the cocking shaft past the spring-biased abutment member 46. In this manner the pigtail yarn guide 30 is moved into the latched second position.

The rotation of the cocking shaft 36 is transmitted essentially simultaneously by the connecting link member 54, in a manner to be described, to the second yarn guide or yarn laying guide 32 for rotation of the yarn laying guide into the latched second position.

As the cocking shaft 36 is rotated, its motion is transmitted to the cocking shaft throw 52, which is pivotally connected eccentrically to one end of the connecting link member 54. The one end of the connecting link member is caused to be swung eccentrically around the cocking shaft from one side thereof to the side illustrated in FIG. 2, in turn transmitting the motion of the connecting link member to and causing rotation of the circular rotatable throw member 56. The opposite end of the connecting link member 54 is eccentrically pivotally connected to the rotatable throw member.

The rotation of the circular rotatable throw member 56 is in turn transmitted to the rotatable shaft 58 to which the latter is fixed for rotation with the former.

As the rotatable shaft 58 is rotated, one of its oppositely disposed shoulders, 62, is moved into camming engagement with one side of the abutment member 66 that extends from the rotatable cam throw 64, thereby causing the rotatable cam throw to be rotated. The rotation of the rotatable cam throw is transmitted to the yarn laying guide through cam link 70. One end of the cam link is pivotally connected to the rotatable cam throw 64 within the slot 68 in the abutment member 66, and the other end is pivotally connected to the yarn laying guide 32. The cam link is translated laterally as the rotatable cam throw is rotated until the cam link comes into engagement with the stop member 71 (FIG. 1). The cam link and rotatable cam throw not only constitute part of the latching mechanism to latch the yarn laying guide in its latched second position, but also constitute part of an over-the-center toggle mechanism.

The operator then threads the continuously moving yarn into the pigtail guide 42. The yarn is now approaching the winder from above, past and over the two guide bars 26, 28, through the yarn laying guide 32, through the pigtail yarn guide 30 and into the air doffer (not illustrated) to a waste receiver (also not illustrated).

The operator then presses the release button 74, which is connected to the abutment member 46 and thus pushes it against its spring bias out of latching engagement with the latch tongue 44 on the cocking shaft. The pigtail yarn guide 30 is thereby released for spring-biased movement in a predetermined path in return to the first position. The pigtail yarn guide translates the continuously moving yarn into engagement with the outer axial end of the rotating yarn package tube 12 where the end slit 76 rotates around clockwise to snag and retain the yarn on the yarn package tube. The sudden increase in tension between the snagged yarn in the end slit and the yarn passing into the air doffer is such as to cause a snapping of the yarn or severing from the yarn going to the waste receiver (not shown). The snagging action takes place at about the 10 o'clock position when facing the yarn tube, as shown in FIG. 2.

When the yarn is snagged, the yarn is wrapped into a waste bunch (not illustrated) on the yarn package tube. The waste bunch serves to secure and prevent the yarn from slipping off the package tube, prior to the formation of the transfer tail.

The pigtail yarn guide 30 continues to move in return toward its first position, the motion of the pigtail yarn guide being transmitted to the cocking shaft throw 52, the connecting link member 54, the rotatable throw member 56 and the rotatable shaft 58. The latter motion causes the one oppositely disposed shoulder 62 on the rotatable shaft to be moved away from a location adjacent one side of the abutment member 66 on the rotatable cam throw 64 and causes the other oppositely disposed shoulder 60 to move into camming engagement against the opposite side of the abutment member 66. The shoulder 60 initiates the return movement in the opposite direction of the rotatable cam throw 64 and hence the release of the yarn laying guide.

As the spring-biased cam link 70 moves from the latched position toward the center position of the toggle mechanism, it moves in an arc from where the straight-line distance between the two points of connection on the cam link (that is, between the yarn laying guide and the rotatable cam throw along the cam link) is the shortest to the center position where such straight-line distance is the longest. The movement of the cam link along this arc is transmitted to the yarn laying guide, thereby causing it to be moved backward a short distance. During this backward movement the yarn laying guide guides the yarn moving through it to form some tying wraps that extend from one side of the waste bunch to the other side. In this manner the waste bunch is held more securely to the end portion of the yarn tube to minimize any possible risk of the waste bunch being accidently removed before it is intended and thereby also pull out the formed transfer tail. When the spring-biased cam link continues in its movement part the center position, the motion is transmitted to the yarn laying guide causing it to move forward, thus guiding the typing wraps in return across the waste bunch, preparatory to forming the transfer tail. The extent of the arc may be adjusted by adjusting the position of the stop member 71, thus controlling the number of tying wraps.

The over-the-center toggle arrangement gives a sudden impetus to the yarn laying guide once it passes its center position, thereby overcoming the inertia of the yarn laying guide and causing it to be moved quickly up to desired speed in return to the first position. Such desired speed, coordinated with the speed of rotation of the yarn tube, determines the spacing and number of transfer tail wraps.

As the yarn laying guide moves along its predetermined path, the yarn is formed in spaced wraps or spaced helices (not illustrated) until in its path of movement the yarn laying guide swings away from the yarn package tube, thereby releasing the yarn as it slips from out of the U-shaped guide 34 for subsequent pickup of the yarn by the self-threading yarn traverse guide 22.

The tension and angle on the yarn as it approaches from above the winder to the yarn traverse winder 10 causes the yarn to continue to be moved axially inwardly a short distance along the guide bars 26, 28, upon release of the yarn from the yarn laying guide and before pickup by the self-threading traverse guide 22. Upon such pickup, the package portion (not illustrated) is then wound. The guide bars 26, 28, thus serve the additional purpose of guiding the yarn to the yarn traverse guide.

The initial concept of the manner in which the transfer tail is formed is, of course, not the subject of this invention. Its description is given, however, to show the cooperation of the various elements.

As may be now apparent from the preceding description, an economy of parts is achieved by having certain elements perform more than one function. The over-the-center toggle arrangement constitutes not only a latching arrangement for the yarn laying guide but also serves, when the release occurs, to provide a controlled backward movement of the yarn laying guide and then serves to overcome its inertia and bring the yarn laying guide up to desired return speed.

This invention has been described in detail with particular reference to preferred embodiments thereof, but it will be understood that variations and modifications can be effected within the spirit and scope of the invention.

I claim:

1. In a transfer tail apparatus having a housing, a first yarn guide means connected to the housing and movable in a path from an unlatched position to a latched position and upon release and in return to the unlatched position adapted to translate a yarn into engagement with the outer axial end of a rotating yarn package tube for subsequent snagging by the yarn tube, and having means for moving the first yarn guide means to its unlatched position; and having a second yarn guide means connected to the housing and movable in a path from an unlatched position to a latched position and, upon sequential subsequent release and in return to the unlatched position after the yarn has been snagged on the yarn package tube and is being wound thereon to form a waste bunch to secure the yarn to the yarn tube, adapted to guide the yarn onto and along an end portion of the yarn tube to form a transfer tail on the yarn package tube end portion and then into the path of a reciprocating yarn traverse guide for subsequent pick-up of the yarn by the yarn traverse guide from the second yarn guide means to form the yarn package, and having means for moving the second yarn guide means to its unlatched position; the improvement comprising:

means connected to the housing for moving both the first yarn guide means and the second yarn guide means simultaneously to their respective latched positions, said means comprising:

a cocking shaft connected to the first yarn guide means and having a handle by which an operator may rotate the cocking shaft and move the first yarn guide means to the latched position;

cooperating latch means on the cocking shaft and the housing for retaining the first yarn guide means in the latched position;

connecting means to and between the cocking shaft and the second yarn guide means for moving the second yarn guide means to its latched position and including latch means for retaining the second yarn guide means in the latched position; and means connected to the housing by which the operator initiates the release of the latch means for the first yarn guide means from its latched position for return movement to the unlatched position and sequential subsequent release of the latch means for the second yarn guide means from its latched position for return movement to the unlatched position.

2. In a transfer tail apparatus as defined in claim 1, said connecting means to and between the cocking shaft and the second yarn guide means including a lost motion means operable by the first yarn guide means during its return movement for effecting the sequential subsequent release of the second yarn guide means from its latched position.

3. In a transfer tail apparatus as defined in claim 2, said lost motion means comprising:

a rotatable shaft which is rotated by the movement of the cocking shaft to and from the latched position of the first yarn guide means, said rotatable shaft having a pair of oppositely disposed shoulders spaced from one another; and a rotatable cam throw concentrically disposed around but freely rotatable relative to the rotatable shaft and having an abutment member projecting therefrom for engagement into rotation by either of the pair of oppositely disposed shoulders on the rotatable shaft.

4. In a transfer tail apparatus as defined in claim 1, said connecting means to and between the cocking shaft and the second yarn guide means comprising:

a throw member connected to the cocking shaft;

a link member pivotally connected at one of its ends to one end of the throw member;

a rotatable throw member pivotally connected to the other end of the link member;

a rotatable shaft connected to and for rotation with the rotatable throw member, the rotatable shaft having a pair of oppositely disposed shoulders;

a rotatable cam throw concentrically disposed around but freely rotatable relative to the rotatable shaft and having an abutment member projecting therefrom for engagement into rotation by either of the pair of oppositely disposed shoulders on the rotatable shaft; and a cam link pivotally connected at one end to the rotatable cam throw and at its other end pivotally connected to the second yarn guide means.

5. In a transfer tail apparatus having a housing, a first yarn guide means connected to the housing and movable in a path from an unlatched position to a latched position and upon release and in return to the unlatched position adapted to translate a yarn into engagement with the outer axial end of a rotating yarn package tube for subsequent snagging by the yarn tube, and having means for moving the first yarn guide means to its unlatched position; and having a second yarn guide means connected to the housing and movable in a path from an unlatched position to a latched position and, upon sequential subsequent release and in return to the unlatched position after the yarn has been snagged on the yarn package tube and is being wound thereon to form a waste bunch to secure the yarn to the yarn tube, adapted to guide the yarn onto and along an end portion of the yarn tube to form a transfer tail on the yarn package tube end portion and then into the path of a reciprocating yarn traverse guide for subsequent pick-up of the yarn by the yarn traverse guide from the second yarn guide means to form the yarn package, and having means for moving the second yarn guide means to its unlatched position; the improvement comprising:

means on the housing interconnecting the first and second yarn guide means for moving them simultaneously to their respective latched positions;

means for latching each of the first and second yarn guide means in their latched positions; and means for releasing the first yarn guide means for movement in return to the unlatched position;

the means for latching the second yarn guide means including a time delay means responsive to the movement of the first yarn guide means toward the unlatched position at a predetermined point along the path of the first yarn guide means to initiate the release of the second yarn guide means and also including means to give an impetus to the second yarn guide means for overcoming its inertia when released from its latched position to bring it up to a desired speed in return to the unlatched position.

6. In a transfer tail apparatus as defined in claim 5, said means for latching the second yarn guide means including means effective after release of the second yarn guide means from the latched position to move the second yarn guide means initially backward to a predetermined extent so as to guide yarn passing through the second yarn guide into tying wraps across the waste bunch.

* * * * *